US007675353B1

(12) United States Patent
Mack

(10) Patent No.: US 7,675,353 B1
(45) Date of Patent: Mar. 9, 2010

(54) CONSTANT CURRENT AND VOLTAGE GENERATOR

(75) Inventor: Michael Peter Mack, Sunnyvale, CA (US)

(73) Assignee: Atheros Communications, Inc., Santa Clara, CA (US)

( * ) Notice: Subject to any disclaimer, the term of this patent is extended or adjusted under 35 U.S.C. 154(b) by 590 days.

(21) Appl. No.: 11/120,689

(22) Filed: May 2, 2005

(51) Int. Cl.
*G05F 3/02* (2006.01)

(52) U.S. Cl. ..... 327/539

(58) Field of Classification Search ..... 327/313, 327/539

See application file for complete search history.

(56) References Cited

U.S. PATENT DOCUMENTS 6,489,835 B1 * 12/2002 Yu et al. ..... 327/539
2004/0108888 A1 * 6/2004 Nemoto ..... 327/539
2004/0169549 A1 * 9/2004 Liu ..... 327/539
2005/0237045 A1 * 10/2005 Lee et al. ..... 323/313
2006/0132223 A1 * 6/2006 Cherek ..... 327/538

* cited by examiner

*Primary Examiner*—Lincoln Donovan
*Assistant Examiner*—Khareem E Almo
(74) *Attorney, Agent, or Firm*—Bever, Hoffman & Harms, LLP; Jeanette S. Harms

(57) ABSTRACT

A compact constant current generator that can operate with a positive supply voltage of 1.22 V (or lower) and minimize noise is provided. The constant current generator can include a bandgap reference circuit and a single gain stage. Notably, the bandgap reference circuit can advantageously generate differential node voltages. The gain stage can amplify those differential node voltages and generate a constant current having a temperature coefficient substantially equal to zero. Advantageously, this single gain stage can minimize the number of components, thereby resulting in a compact and efficient current generator.

8 Claims, 4 Drawing Sheets

CONSTANT CURRENT AND VOLTAGE GENERATOR

BACKGROUND OF THE INVENTION

1. Field of the Invention

The present invention relates to a constant current generator that minimizes silicon resources and noise contribution.

2. Discussion of the Related Art

In many integrated circuits, the analog sections can be biased using either constant currents or constant "IR" currents. A constant current Ic can be generated by applying a fraction (f) of a bandgap reference voltage (VREF) across an external resistor (Rext), i.e. Ic=f*VREF/Rext. FIG. 1A illustrates an exemplary voltage-to-current converter 100 for generating a constant current Ic. In converter 100, a bandgap reference voltage circuit 101 can generate a reference voltage VREF, which is provided to a positive terminal of an operational amplifier 102. The output terminal of operational amplifier 102 is connected to a gate of an NMOS transistor 103. The source of NMOS transistor 103 is connected to a low voltage source VSS via an external resistor 104 as well as to the negative terminal of operational amplifier 102. The drain of NMOS transistor 103 provides the constant current Ic.

In a typical embodiment, bandgap reference voltage circuit 101 includes another operational amplifier. For example, FIG. 1B illustrates an exemplary bandgap reference voltage circuit 101 that includes an operational amplifier 116, which provides its output to a node 117. The collectors and bases of two pnp transistors 113 and 115 are connected to low voltage source VSS. The emitter of pnp transistor 113 is connected to node 117 via two resistors 112 and 111, which are connected in series. A node between resistors 111 and 112 is connected to the negative input terminal of operational amplifier 116. The emitter of pnp transistor 115 is connected to the positive input terminal of operational amplifier 116 and to a resistor 114, which is also connected to node 117.

A bandgap reference voltage VREF can be created by adding a diode voltage, which has a well-known negative temperature coefficient, with a voltage that is proportional to absolute temperature (ptat) in such a way that the temperature coefficient of the combination is nearly zero. In the configuration of bandgap reference voltage circuit 101, resistors 111, 112, and 114 as well as pnp transistors 113 and 115 can be appropriately sized to ensure that the temperature coefficient of VREF is balanced, i.e. substantially zero. This balancing can occur when VREF is approximately 1.22 V.

A constant IR current can be similarly generated by applying a fraction of a bandgap reference voltage across an internal resistor (e.g. polysilicon) (Rint), i.e. constant IR current=f*Vbg/Rint. Because a device may require both a constant current as well as a constant IR current, such a device generally includes a bandgap reference voltage circuit (e.g. bandgap reference voltage circuit 101) and two voltage-to-current converters, i.e. a first voltage-to-current converter for the constant current (e.g. converter 100) and a second voltage-to-current converter for the constant IR current (identical to converter 100, wherein resistor 104 is an internal resistor).

Unfortunately, the bandgap reference voltage circuit and its corresponding voltage-to-current converters have many components that use significant area on an integrated circuit. Moreover, distributing a reference voltage can undesirably contribute to noise and offset in a device. An ideal voltage reference presents a zero impedance source of voltage. Unfortunately, interconnections on integrated circuits have finite impedances, which may allow noise from adjacent traces to be capacitively coupled to a voltage reference line.

Further, a voltage reference must be compared to some other voltage, typically "ground." If the absolute voltage of "ground" at the point of voltage reference generation is not the same as "ground" at the point where the reference is used, then the reference voltage will appear to have an error equal to the difference in ground potentials. A difference in ground potentials is a common problem in large-scale integrated circuit design. Additionally, as process technologies scale and voltage supplies are lowered, even generating bandgap reference voltages becomes challenging. For example, positive voltage supplies can now be at 1.8 V or below.

Therefore, a need arises for a more compact, noise minimizing constant current generator that can operate with a positive voltage supply equal to or less than 1.22 V.

SUMMARY OF THE INVENTION

A compact constant current generator that can operate with a positive supply voltage of 1.22 V (or lower) and minimize noise is described. The constant current generator can include a bandgap reference circuit and a single gain stage. Notably, the bandgap reference circuit can advantageously generate differential node voltages. The gain stage can amplify those differential node voltages and generate a constant current having a temperature coefficient substantially equal to zero. Advantageously, this single gain stage can minimize the number of components, thereby resulting in a compact current generator. Additionally, the accurate constant IR current (rather than a reference voltage) can be distributed, thereby minimizing noise in the device.

In one embodiment (FIG. 2), the gain stage can include a single operational amplifier that receives the differential node voltages on its input terminals. The operational amplifier advantageously drives a feedback path to ensure that its voltage inputs are substantially equal. In addition to an operational amplifier, this constant current generator can include bipolar transistors, MOS transistors, and resistors.

For example, the bandgap reference circuit can include first and second bipolar transistors as well as first, second, and third resistors. The first bipolar transistor and the first resistor can be connected between a low voltage source VSS and a first input terminal of the operational amplifier. A second resistor can be connected between VSS and the first input terminal of the operational amplifier. The second bipolar transistor can be connected between VSS and a second input terminal of the operational amplifier. The third resistor can be connected between VSS and the second input terminal of the operational amplifier. The bandgap reference circuit can further include a first MOS transistor connected between the first input terminal of the operational amplifier and a positive voltage source VDD. A second MOS transistor can be connected between the second input terminal of the operational amplifier and VDD.

The gain stage further can include third, fourth, and fifth MOS transistors. The operational amplifier can drive the gate of the third MOS transistor, which can have its source coupled to VSS. The fourth MOS transistor can be connected between the drain of the third MOS transistor and VDD. The fifth MOS transistor can be connected to VDD. The first, second, fourth, and fifth MOS transistors can have gates connected to the drain of the third MOS transistor, and the fifth MOS transistor can output the constant IR current.

In another embodiment, the gain stage can be implemented without an operational amplifier. In this embodiment, the bandgap reference circuit can include first and second bipolar transistors as well as first through fifth resistors. The first bipolar transistor and the first resistor can be connected between VSS and a first node. The collector and base of the first bipolar transistor can be connected to VSS whereas its emitter can be connected to the first resistor. The second resistor can be connected between VSS and the first node. The third resistor can be connected between the first node and a first input terminal of the gain stage.

The second bipolar transistor can be connected between VSS and a second node. The collector and base of the second bipolar transistor can be connected to VSS whereas its emitter can be connected to the second node. The fourth resistor can be connected between VSS and the second node. The fifth resistor can be connected between the second node and a second input terminal of the gain stage.

In one embodiment, the gain stage can include first, second, third, fourth, and fifth MOS transistors. The first MOS transistor and the second MOS transistor can be connected in series between the third resistor and VDD. Similarly, the third MOS transistor and the fourth MOS transistor can be connected in series between the fifth resistor and VDD. A fifth MOS transistor can have its source and its drain connected to VDD. The gates of the first and third MOS transistors can be connected to the drain of the fourth MOS transistor. The gates of the second, fourth, and fifth MOS transistors can be connected to the drain of the second MOS transistor.

The constant current generator can further include a current mirror circuit connected to its gain stage. In one embodiment, the current mirror circuit can include one or more additional MOS transistors. Each MOS transistor can have its source connected to VDD, its gate connected to the gate of the second MOS transistor, and its drain for providing the constant current.

In one embodiment, the constant current generator can further include a startup circuit connected to the bandgap reference circuit and the gain stage. This startup circuit can include a third bipolar transistor, a sixth resistor, as well as sixth and seventh MOS transistors. The sixth resistor can be connected to the positive voltage source. The sixth MOS transistor can have its drain and gate connected to the sixth resistor. The seventh MOS transistor can have its drain connected to the gate of the fourth MOS transistor, its gate connected to the gate of the sixth MOS transistor, and its source connected to the second input terminal of the gain stage. The third bipolar transistor can have its base and collector connected to the low voltage source and its emitter connected to the source of the sixth MOS transistor.

A method of generating a constant IR current is also described. In this method, differential node voltages can be generated using a bandgap reference circuit. Advantageously, these differential node voltages can be amplified and the constant current can be generated. This accurate IR constant current can be advantageously distributed to any area of the integrated circuit with minimal noise. A constant reference voltage can be generated locally by forcing the constant current through a resistor connected to VSS.

DETAILED DESCRIPTION OF THE FIGURES

A conventional constant current generator, which includes both a bandgap reference voltage circuit and its corresponding voltage-to-current converter(s), has many components, thereby taking up valuable silicon area on an integrated circuit. Moreover, conventional constant current generators receive a distributed reference voltage and then locally convert that reference voltage into a constant current, thereby undesirably reproducing noise associated with the distributed reference voltage in the generated constant current and further undesirably increasing the number of devices necessary to generate currents.

In accordance with one aspect of the invention, a constant current generator includes a bandgap reference circuit that can generate differential node voltages. A single gain stage can amplify those differential node voltages and advantageously generate a constant current having a temperature coefficient substantially equal to zero. Having a single gain stage can minimize the number of components, thereby resulting in a compact current generator having a relatively low number of noise generating components. Moreover, by distributing an accurate constant current, noise in the device can also be minimized.

Figure 1B:
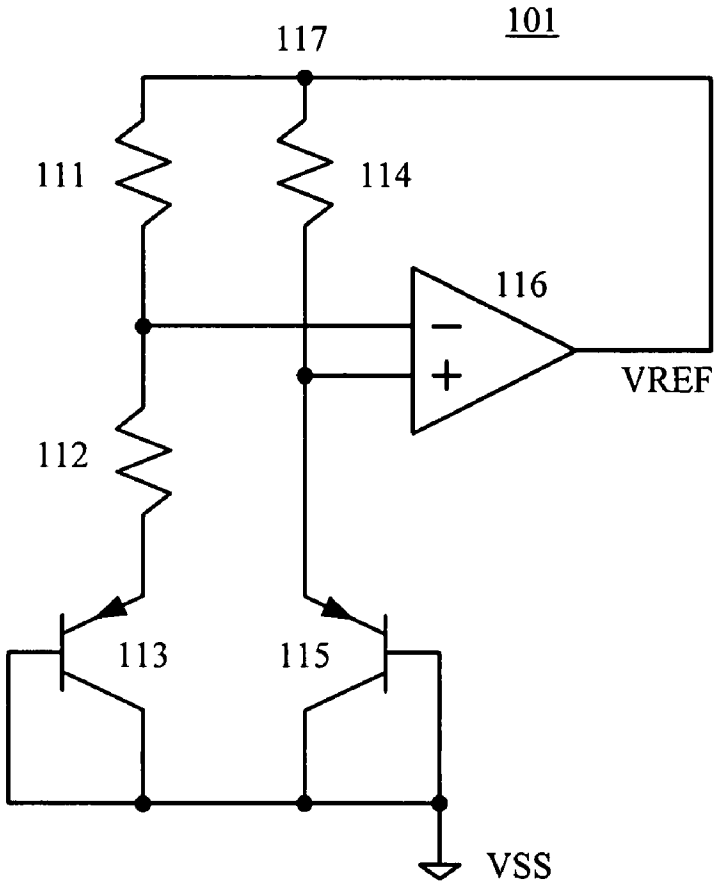
FIG. 1B illustrates an exemplary bandgap reference voltage circuit that includes an operational amplifier.
Figure 1A:
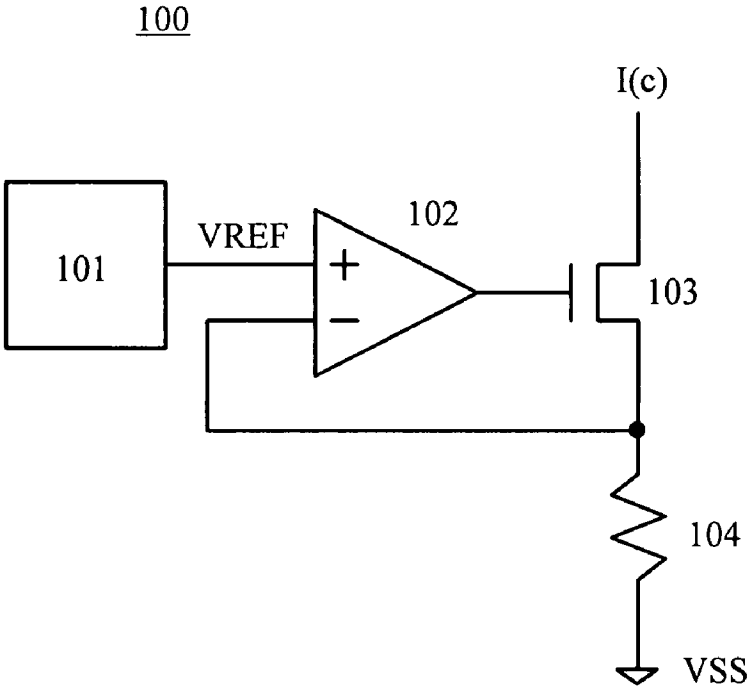
FIG. 1A illustrates an exemplary voltage-to-current converter for generating a constant current Ic.
Figure 2:
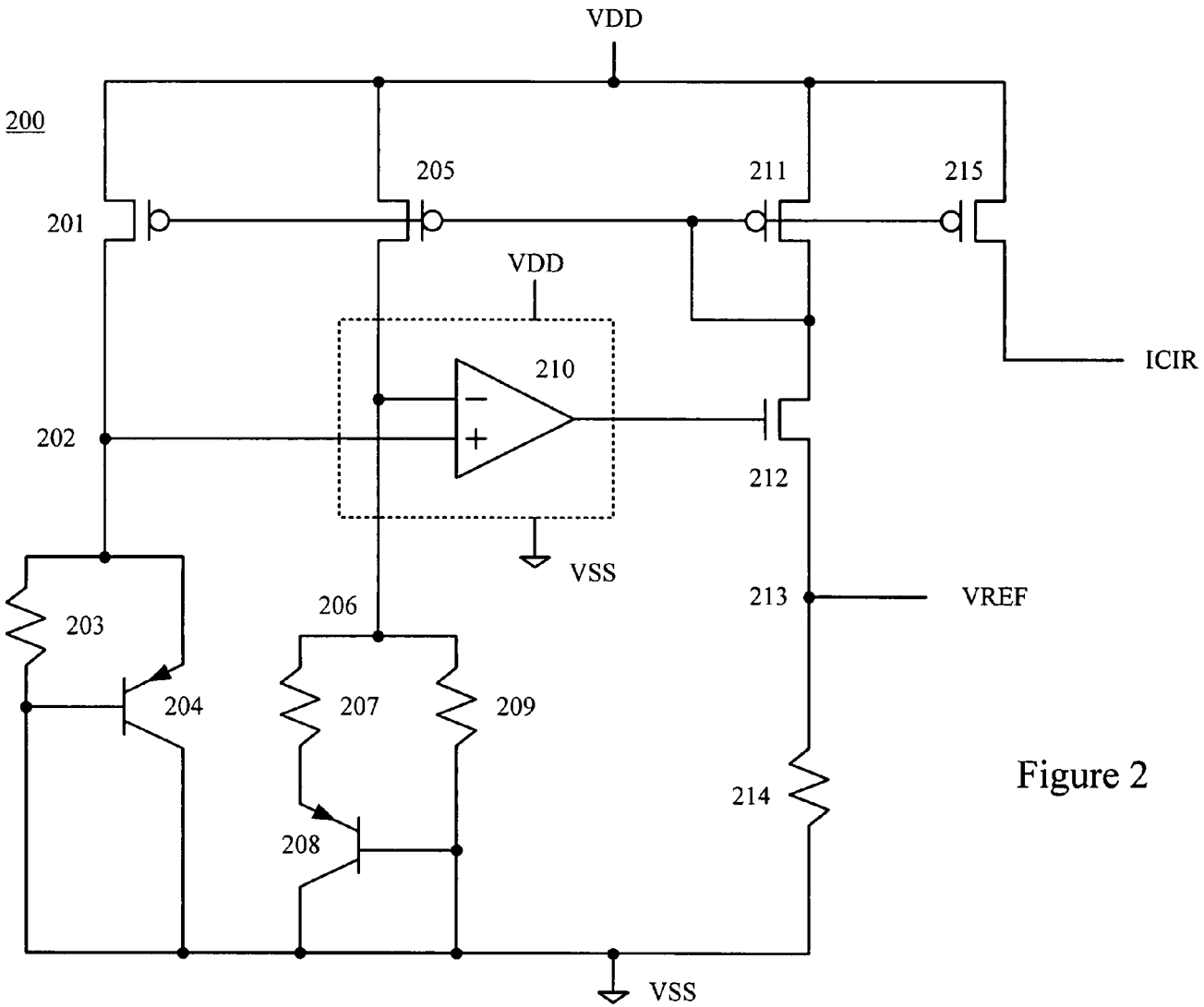
FIG. 2 illustrates one embodiment of a constant current generator.

FIG. 2 illustrates one embodiment of a constant current generator 200. Constant current generator 200 is configured such that an amplifier 208 forces the voltage at a node 202 (provided to its positive input terminal) and the voltage at a node 206 (provided to its negative input terminal) to be substantially the same. Notably, the currents through PMOS transistors 201, 205, 211, and 215 are proportional to each other. For example, in one embodiment, the current through PMOS transistor 201 can be 4 times the current through PMOS transistors 205, 211, and 215.

All materials exhibit a change in characteristics when their temperature is changed. In other words, each material may change resistance according to temperature by a certain amount. For example, the base-emitter junction of a bipolar transistor may exhibit a change in diode drop (i.e. Vbe) when temperature is changed. A positive temperature coefficient (also called a temperature coefficient or tempco) means that a characteristic increases with increasing temperature. Conversely, a negative temperature coefficient means that that characteristic decreases with increasing temperature.

Advantageously, the temperature coefficients of the various components associated with each input to operational amplifier 208 can be balanced. That is, the temperature coefficients of such components when summed substantially equal zero. Thus, for example, the negative temperature coefficient expressed by current flowing through pnp transistor 208 can effectively balance the temperature coefficient of pnp transistor 204.

The component configuration of constant current generator 200 is now described. In this embodiment, a PMOS transistor 201 is connected between a positive voltage source VDD and node 202. A resistor 203 is connected between node 202 and a low voltage source VSS. An emitter of a pnp transistor 204 is connected to node 202 whereas the collector and the base of pnp transistor 204 are connected to low voltage source VSS. Another PMOS transistor 205 is connected between a positive voltage source VDD and node 206. A resistor 209 is connected between node 206 and low voltage source VSS. A resistor 207 is connected between node 206 and an emitter of another pnp transistor 208. The collector and the base of pnp transistor 208 are connected to low voltage source VSS.

The output terminal of operational amplifier 210 drives a gate of an NMOS transistor 212. The source of NMOS transistor 212 is coupled to low voltage source VSS via a resistor 214. A PMOS transistor 211 is connected between positive voltage source VDD and the drain of NMOS transistor 212. A drain of a PMOS transistor 215 is connected to positive voltage source VDD. The gates of all PMOS transistors 201, 215, 211, and 215 are connected to the drain of NMOS transistor 212, thereby forming current mirrors. The drain of PMOS transistor 215 provides the constant current ICIR whereas a node 213, positioned between the source of NMOS transistor 212 and resistor 214, provides the bandgap reference voltage VREF.

In this configuration, the current flowing through PMOS transistors 201 and 205 is advantageously constant with respect to temperature. This current can be computed by multiplying the thermal voltage (Vt) of pnp transistor 208 by the natural logarithm of m (LN(m)) (i.e. the inverse function of exp(m)) and then dividing this product by the resistance of resistor 207 (i.e. Vt*LN(m)/R(207)). Note that Vt for pnp transistor 208 is 0.0259 V at room temperature (i.e. 300° K.) and m is the ratio of the emitter areas of pnp transistors 208 and 204 multiplied by the ratio of the collector currents in pnp transistors 204 and 208. Typically, m is 8×4=32.

Because the voltages at nodes 202 and 206 are one base-emitter voltage above ground, a Vbe current can be produced by inserting resisters 203 and 209 from nodes 202 and 206 to ground, respectively. Note that resistors 203 and 209 can be advantageously sized so that the ratio of the currents flowing through them is the same as that of the currents flowing through pnp transistors 204 and 208.

The current flowing through PMOS transistor 205 can be computed by summing the ptat current, i.e. Vt*LN(m)/R(207), and the Vbe current, i.e. Vbe/R(209). Advantageously, the size of resistors 207 and 209 can be selected so that the temperature coefficient of the combined current is substantially zero. To appropriately size resistors 207 and 209, Vbe as a function of temperature can be computed using Eq. 1.

$$Vbe(t)=Vbe0-a*t \quad \text{(Eq. 1)}$$

wherein Vbe0 is the base-emitter voltage of pnp transistor 204 extrapolated to zero degrees Kelvin, a is the temperature coefficient, and t is the variable temperature in degrees Kelvin. The Vbe of a pnp transistor at 300 K is known to be, for example, 0.767 V. Similarly, the temperature coefficient "a" is known to be 1.53 mV/degC. Note that the temperature unit, i.e. mV/degC, is effectively the same as mV/degK because a one degree change is the same in degC and in degK. DegC can be converted to degK by adding 273. Therefore, Vbe0=1.226 V.

When the input voltages provided to operational amplifier 210 are equal, then the current through PMOS transistor 205 can be computed by $$I=Vbe0/R(209)+Vt*Ln(m)/R(207) \quad \text{(Eq. 2)}$$

In one embodiment, m is equal to 96 because the area of pnp transistor 208 is 24 times larger than the area of pnp transistor 204 and the current through pnp transistor 204 is four times the current through pnp transistor 208 (24*4=96).

The variable Vt, which represents the thermal voltage of the pnp transistor, can be defined by:

$$Vt=Vtx*T/300K \quad \text{(Eq. 3)}$$

Note that Vtx=(k×T)/q, wherein k is Boltzman's constant and q is $1.38\times10^{-23}$ Coloumbs. Thus, Vtx at 300 K is equal to 0.0259 volts.

Therefore, using Eqs. 1, 2, and 3, the current I for all temperatures can be computed by:

$$I=Vbe0/R(209)-Vtx*LN(m)*T/300/R(207)-a*T/R(209) \quad \text{(Eq. 4)}$$

Setting dI/dT=0, yields:

$$-a/R(209)+Vtx*LN(m)/300K/R(207)=0 \quad \text{(Eq. 5)}$$

Thus, $$(R209)/R(207)=300K*a/Vtx/LN(m) \quad \text{(Eq. 6)}$$

Plugging Eq. 6 into Eq. 4 results in:

$$I=(Vbe0/R(207))*(Vtx*LN(m)/300K/a) \quad \text{(Eq. 7)}$$

If the diode temperature behavior is not perfectly linear, there will be a residual temperature coefficient in the current flowing through PMOS transistor 205. Or, if the diode temperature behavior is linear, then current I can be simplified to:

$$I=Vbe0/R(209) \quad \text{(Eq. 8)}$$

In this configuration of constant current and voltage generator 200, $$Vref=I*R(214) \quad \text{(Eq. 9)}$$

Using the above equations, if Vbe0=1.226 V, a=1.53 mV/deg C, m=96, Vtx=0.0259, and R(209)=49 k, then R(209)/R(207)=3.8898, R(207)=12.6 k, and I=25 pA. Note that with R(214)=20 k, Vref=500 mV.

Referring back to FIG. 2, operational amplifier 210 can drive the gate of NMOS transistor 212 until the current flowing in PMOS transistors 201 and 205 cause the input voltages provided to operational amplifier 210 to balance. When this happens, the current flowing through NMOS transistor 212 and the voltage produced across resistor 214 are also constant. This voltage can be selected by choosing the ratio of the resistances of resistors 214 and 209 as well as the ratio of the widths of PMOS transistors 205 and 211.

In one embodiment of constant current generator 200, resistor 207 can have a resistance R, resistor 209 can have a resistance R2, resistor 203 can have a resistance R2/4, and resistor 214 can have a resistance of R3. In this embodiment, PMOS transistors 205, 211, and 215 can have a width of 10 μm, a length of 2.5 μm, and an m of 20. PMOS transistor 201 can have a width of 10 μm, a length of 2.5 μm, and an m of 80. NMOS transistor 212 can have a width of 10 μm, a length of 2 μm, and an m of 20.

Figure 3:
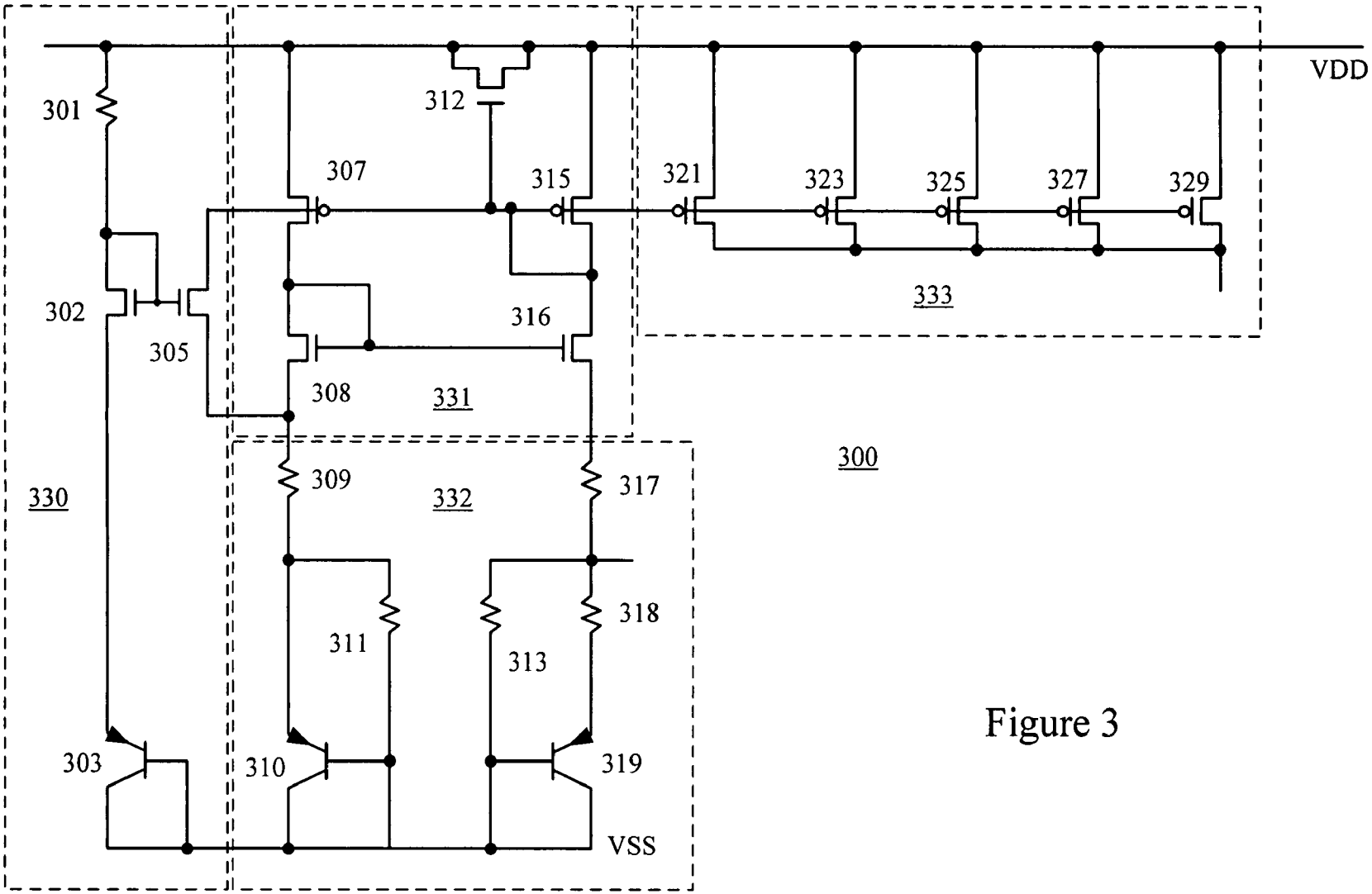
FIG. 3 illustrates a constant current generator that eliminates the use of an amplifier.

FIG. 3 illustrates a constant current generator 300 that eliminates the use of an amplifier. Specifically, constant current generator 300 can include a start-up circuit 330 (which could also be used for constant current generator 200 of FIG. 2), a gain stage circuit 331, a bandgap reference circuit 332 (that can effectively perform the functions of pnp transistors 204 and 208, resistors 203, 207, and 209, all of FIG. 2), and a current mirror circuit 333.

The component configuration of constant current generator 300 is now described. Note that the resistors shown in constant current generator 300 can be implemented with polysilicon (n-type silicon) resistor networks to provide predetermined resistances, but for simplicity are referenced hereafter simply as resistors. For example, in one embodiment that attempts to balance design time and circuit complexity, each of resistors 309 and 317 can be implemented using N resistors (e.g. N(309)=1, N(317)=7:1), wherein each resistor can have a length of 5.8 μm and a width of 1.1 μm. Similarly, each of resistors 311, 313, and 318 can also be implemented using N resistors (e.g. N(311, 318)=9:1, N(313)=39:1), wherein each resistor can have a length of 7 μm and a width of 1.1 μm. Note that in other embodiments, the resistor networks can be instantiated by using cells from a user library or in yet other embodiments a resistor can be custom built for a particular application.

In this embodiment, a resistor 301 and an NMOS transistor 302 are connected in series between a positive voltage source VDD and an emitter of a pnp transistor 303. The base and collector of pnp transistor 303 are connected to a low voltage source VSS. The source of an NMOS transistor 305 is connected to a first terminal of a resistor 309. The second terminal of resistor 309 is connected to a first terminal of a resistor 311 and an emitter of a pnp transistor 310. The second terminal of resistor 311 as well as the collector and base of pnp transistor 310 are connected to VSS. The gates of NMOS transistors 302 and 305 are connected to the drain of NMOS transistor 302.

The source and drain of an PMOS transistor 312 are connected to VDD. The drains of PMOS transistors 307, 315, 321, 323, 325, 327, and 329 are connected to VDD whereas the gates of those transistors (and the gate of PMOS transistor 312) are connected to the drain of NMOS transistor 305 and the source of NMOS transistor 315. In one embodiment, each PMOS transistor 321, 323, 325, 327, and 329 can generate a 25 μA current, thereby allowing gain circuit 333 to generate a 125 μA reference current.

An NMOS transistor 308 is connected between the drain of PMOS transistor 307 and the first terminal of resistor 309. An NMOS transistor 316 is connected between the drain of PMOS transistor 315 and the first terminal of a resistor 317. The gates of NMOS transistors 308 and 316 as well as the drain of transistor 307 are connected. The second terminal of resistor 317 is connected to the first terminals of resistors 313 and 318. The second terminal of resistor 313 is connected to the base and collector of a pnp transistor 319 as well as to VSS. The second terminal of resistor 318 is connected to the emitter of pnp transistor 319. Note that although resistors 309 and 317 are shown as part of bandgap reference circuit 332, they can be used to ensure a proper start-up and, therefore, functionally form part of start-up circuit 330.

Although illustrative embodiments of the invention have been described in detail herein with reference to the accompanying figures, it is to be understood that the invention is not limited to those precise embodiments. They are not intended to be exhaustive or to limit the invention to the precise forms disclosed. As such, many modifications and variations will be apparent.

Figure 4:
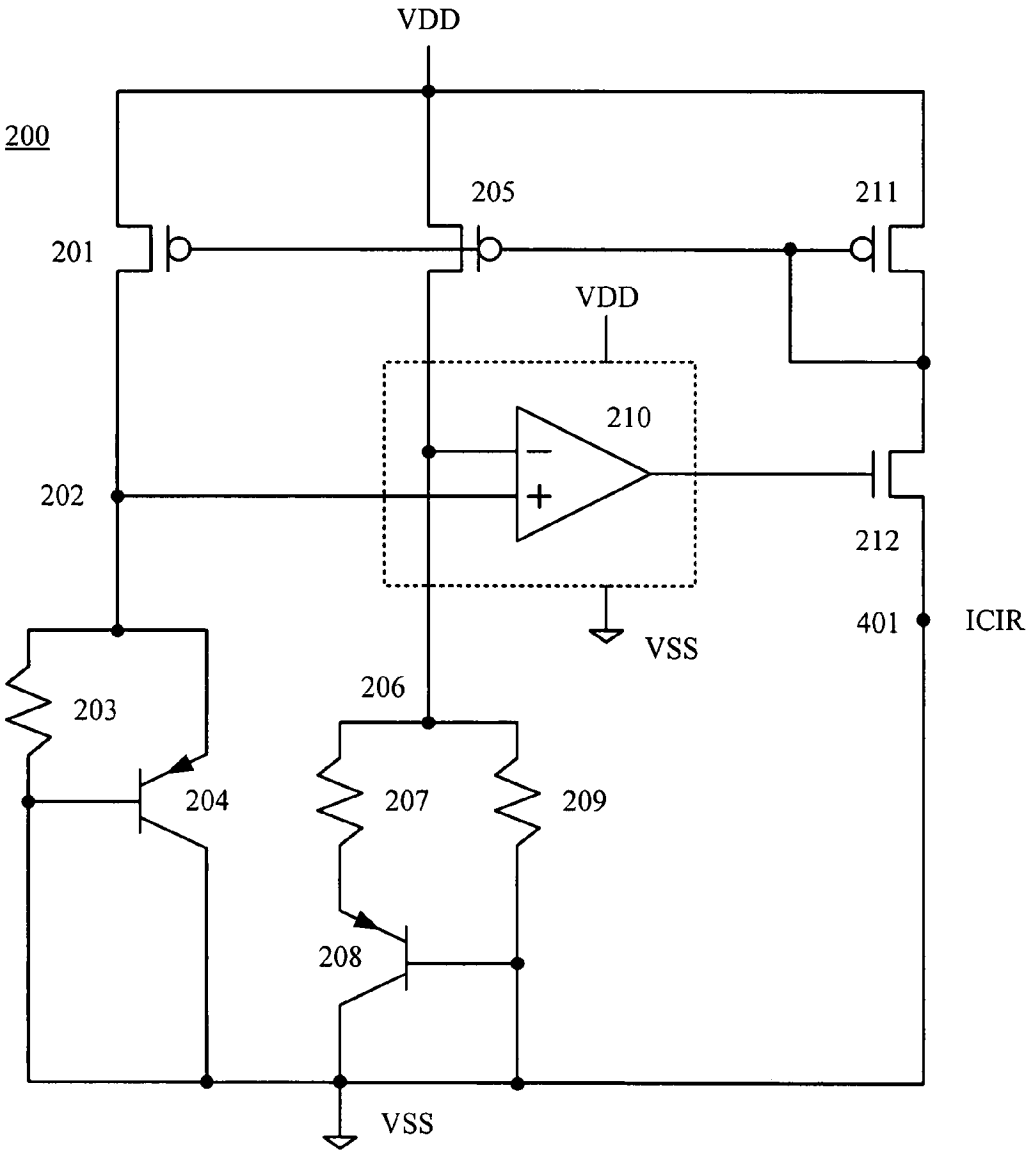
FIG. 4 illustrates a constant current generator that can generate a constant current without generating a constant voltage.

For example, FIG. 4 illustrates a constant current generator 400 that can generate a constant current without generating a constant voltage. Constant current generator 400 includes many of the components of constant current generator 200 (FIG. 2), but eliminates certain other components, namely resistor 214 and PMOS transistor 215. In this embodiment, constant current generator 400 includes a node 401 that provides the constant current ICIR.

Note that other equivalent constant current generators can be implemented using npn transistors, NMOS transistors, and PMOS transistors instead of pnp transistors, PMOS transistors, and NMOS transistors, respectively.

Accordingly, it is intended that the scope of the invention be defined by the following Claims and their equivalents.

The invention claimed is:

1. A constant current generator comprising:

a bandgap reference circuit for generating differential node voltages; and a single gain stage for amplifying the differential node voltages and generating a constant current, wherein the gain stage includes:

a single operational amplifier that receives the differential node voltages on its input terminals;

wherein the bandgap reference circuit includes:

a first bipolar transistor and a first resistor connected in series between a low voltage source and a first input terminal of the operational amplifier, the first bipolar transistor having a base connected to the low voltage source;

a second resistor connected between the low voltage source and the first input terminal of the operational amplifier;

a second bipolar transistor connected between the low voltage source and a second input terminal of the operational amplifier, the second bipolar transistor having a base connected to the low voltage source;

a third resistor connected between the low voltage source and the second input terminal of the operational amplifier;

a first MOS transistor connected between the first input terminal of the operational amplifier and a positive voltage source; and a second MOS transistor connected between the second input terminal of the operational amplifier and the positive voltage source, wherein the gain stage further includes:

a third MOS transistor driven by the operational amplifier, the third MOS transistor having a first terminal connected to the low voltage source;

a fourth MOS transistor connected between a second terminal of the third MOS transistor and the positive voltage source; and a fifth MOS transistor connected to the positive voltage source, wherein the first, second, fourth, and fifth MOS transistors have gates connected to the second terminal of the third MOS transistor, and wherein the fifth MOS transistor outputs the constant current.

2. A constant current generator comprising:

a bandgap reference circuit for generating differential node voltages; and a single gain stage for amplifying the differential node voltages and generating a constant current, wherein the bandgap reference circuit includes:

a first bipolar transistor and a first resistor connected between a low voltage source and a first node, wherein a collector and a base of the first bipolar transistor are connected to the low voltage source and an emitter of the first bipolar transistor is connected to the first resistor;

a second resistor connected between the low voltage source and the first node;

a third resistor connected between the first node and a first input terminal of the gain stage;

a second bipolar transistor connected between the low voltage source and a second node, wherein a collector and a base of the second bipolar transistor are connected to the low voltage source and an emitter of the second bipolar transistor is connected to the second node;

a fourth resistor connected between the low voltage source and the second node; and a fifth resistor connected between the second node and a second input terminal of the gain stage.

3. The constant current generator of claim 2, wherein the gain stage includes:

a first MOS transistor and a second MOS transistor connected in series between the third resistor and the positive voltage source;

a third MOS transistor and a fourth MOS transistor connected in series between the fifth resistor and the positive voltage source; and a fifth MOS transistor having a source and a drain connected to the positive voltage source, wherein gates of the first and third MOS transistors are connected to a drain of the fourth MOS transistor, and wherein gates of the second, fourth, and fifth MOS transistors are connected to a drain of the first MOS transistor.

4. The constant current generator of claim 3, wherein the constant current generator further includes:

a current mirror circuit connected in operative relation to the gain stage.

5. The constant current generator of claim 4, wherein the current mirror circuit includes one or more additional MOS transistors, wherein each additional MOS transistor has is source connected to the positive voltage source, its gate connected to the gate of the second MOS transistor, and its drain providing a constant current.

6. The constant current generator of claim 3, further including:

a startup circuit connected in operative relation to the bandgap reference circuit and the gain stage.

7. The constant current generator of claim 6, wherein the startup circuit includes:

a sixth resistor connected to the positive voltage source;

a sixth MOS transistor having a source connected to the sixth resistor;

a seventh MOS transistor having a source connected to the gate of the fourth MOS transistor, a drain connected to the second input terminal of the gain stage, and a gate connected to the gate and source of the sixth transistor; and a third bipolar transistor having a base and a collector connected to the low voltage source and an emitter connected to the drain of the sixth MOS transistor.

8. A constant current generator comprising:

a gain stage for amplifying differential node voltages and generating a constant current, the gain stage including:

a single operational amplifier that receives the differential node voltages on its input terminals; and a first NMOS transistor driven by the operational amplifier; and a bandgap reference circuit for generating the differential node voltages, the bandgap reference circuit including:

a first bipolar transistor and a first resistor connected in series between a low voltage source and a negative input terminal of the operational amplifier, the first bipolar transistor having a base connected to the low voltage source;

a second resistor connected between the low voltage source and the negative input terminal of the operational amplifier;

a second bipolar transistor connected between the low voltage source and a positive input terminal of the operational amplifier, the second bipolar transistor having a base connected to the low voltage source;

a third resistor connected between the low voltage source and the positive input terminal of the operational amplifier a first PMOS transistor connected between the negative input terminal of the operational amplifier and a positive voltage source; and a second PMOS transistor connected between the positive input terminal of the operational amplifier and the positive voltage source.

* * * * *